United States Patent [19]

Hoover

[11] Patent Number: 4,597,103

[45] Date of Patent: Jun. 24, 1986

[54] BAG CONSTRUCTION WITH IMPROVED GUSSETS

[75] Inventor: Gregory A. Hoover, Bourne, Mass.

[73] Assignee: Sonoco Products Company, Hartsville, S.C.

[21] Appl. No.: 737,637

[22] Filed: May 24, 1985

[51] Int. Cl.[4] ..... B65D 30/20

[52] U.S. Cl. ..... 383/120; 383/2; 383/8

[58] Field of Search ..... 383/2, 120, 8

[56] References Cited

U.S. PATENT DOCUMENTS

| | | | |
|---|---|---|---|
| 2,078,624 | 4/1937 | Wolff | 383/2 |
| 2,085,509 | 6/1937 | Rombold | 383/120 |
| 2,124,287 | 7/1938 | Claviez | 383/120 |
| 4,249,663 | 2/1981 | Hewlett | 383/7 |

FOREIGN PATENT DOCUMENTS

| | | | |
|---|---|---|---|
| 502825 | 5/1920 | France | 383/2 |

*Primary Examiner*—Stephen P. Garbe

*Attorney, Agent, or Firm*—Dennison, Meserole, Pollack & Scheiner

[57] ABSTRACT

A thermoplastic bag with side or bottom gussets each defined by a pair of overlying panels having selected ends thereof sealed together and between the sealed edges of the front and rear walls of the bag. Each gusset includes a transverse tear line inward of the sealed lower ends of the panels of the gusset, and a transverse glue line bonding the two panels of the gusset to each other inward of the tear line and across the width of the gusset.

9 Claims, 12 Drawing Figures

BAG CONSTRUCTION WITH IMPROVED GUSSETS

BACKGROUND OF THE INVENTION

The invention is generally concerned with gusseted bags, and more particularly thermoplastic grocery bags of the type frequently supplied in multiple bag packs for a selected separable dispensing of the individual bags. Such bags may incorporate integral handles and opposed side walls, one or both of which are inwardly folded between the front and rear bag walls to define bag expanding gussets. With side gussets, the gussets extend the full height of the individual bag both to enhance the strength of the handles and to allow for a lateral outward expansion of the bag, when loaded, to increase the carrying capacity thereof.

Another form of known bag incorporates a bottom gusset defined by an inwardly folded bottom having the opposed ends thereof sealed between the corresponding sealed side edges of the front and rear bag walls.

Bags of the type involved herein are frequently formed by utilizing flattened tube portions selectively severed from a length of tubing of appropriate material and heat sealed along the overlying opposed edges thereof.

In bags with side gussets, wherein the bags are heat sealed along the upper and lower edges thereof, opposed full height sections of the tube portions are inwardly folded to form the side walls or gussets. The upper and lower ends of the inwardly folded side walls or gussets are in turn heat sealed to and between the upper and lower edges of the opposed front and rear panels. An appropriate mouth-defining cutout is normally made through the sealed upper portion of the bag with the cutout simultaneously defining both the opposed handles and a central bag mouth.

In bags with bottom gussets, that is a gusset forming the bottom or bottom wall of the bag, the flattened tube portion is heat sealed along the opposed sides thereof with a transverse section inwardly folded between the front and rear bag walls to define the bottom gusset. The opposed ends of the bottom gusset are heat sealed between the heat sealed side edges of the front and rear bag walls.

Plastic bags of the type described above are common in the art as noted in the following patents:

U.S. Pat. No. 3,352,411, Schwarzkopf
U.S. Pat. No. 3,774,838, Christie
U.S. Pat. No. 4,062,170, Orem
U.S. Pat. No. 4,165,832, Kuklies et al
U.S. Pat. No. 4,199,122, Christie
U.S. Pat. No. 4,476,979, Reimann et al
U.S. Pat. No. 4,480,750, Dancy While such bags have, in general, found ready acceptance in the marketplace for a variety of reasons, a troublesome problem has appeared with regard to the tendency of the gussets to "blow out", particularly when large and heavy items are placed within the bag. This involves, in regard to side wall gussets, a "peeling" or tearing loose of the lower end of the gusset from the heat sealed lower seam with the gusset expanding outward and presenting an enlarged open lower end which destroys the integrity of the bag and allows the bagged items to fall therethrough. A similar problem arises with regard to bottom wall gussets wherein both of the opposed seam-sealed ends tend to tear loose and form enlarged openings. Basically, such a tearing takes place when a large and/or heavy load is put in the bag and an excessive force is put on the gusset ends at the expanding bottom of the bag. Such a force can occur under loads which could normally be considered well within the capability of the bag were it not for this tearing action at the lower ends of the gussets.

SUMMARY OF THE INVENTION

The plastic or thermoplastic bag construction of the present invention specifically provides for an accommodation of the tendency of bag gussets to tear open as the gussets expand outward under heavy load conditions. In particular, the bag construction facilitates the outward expansion of the gussets to their full effective width, doing so in a controlled manner which allows for a severing of the effected ends of the gussets from the sealed lower bottom or side edges of the bag, while at the same time retaining the released ends of the gussets sealed.

In order to effect the controlled expansion of a gusset, the overlying two sections or panels of the gusset are provided with tear lines or lines of perforations immediately inward of the involved end or ends of the gussets which are in turn heat sealed between the corresponding edges of the front and rear panels. In addition, immediately inward of the tear lines, the two sections or panels of the gusset, for the full width or height thereof, are glued or otherwise bonded to each other. Constructed in this manner, any tendency for the gusset to "blow out" will result in a controlled tearing of the gusset sections along the tear lines and outward of the glue line whereby a free outward expansion of the end portion of the gusset is readily effected and will result in an inverting of the gusset while the integrity of the sealed end portion of the gusset, and for that matter the entire sealed bottom of the bag, is maintained. It will be appreciated that the proposed bag construction actually relies on and controls the tendency for the gusset to expand outward, providing a stress relief in conjunction with a retention of the sealed integrity of the end of the gusset. The provision for a controlled tearing of the gusset from the sealed main body of the bag also avoids any possible tearing of the bottom of the main portion of the bag itself. In connection therewith, the nature of the tear or perforated lines is such as to provide for a severing therealong prior to structural damage to any other portion of the bag.

It is contemplated that the provision of the line of perforations and the glue line for each appropriate gusset end be effected during the automated construction of the bags. While this might add slightly to the cost of the bags, by removing a design problem and eliminating a tendency to tear inherent in conventional bag construction, it should be possible to reduce the overall thickness of the bag material and thus more than offset the additional expense involved in the provision of the tear lines and the glue lines.

The significance of the invention will become more apparent as the details of construction and operation are more fully hereinafter described and claimed.

DESCRIPTION OF THE PREFERRED EMBODIMENT

Figure 1:
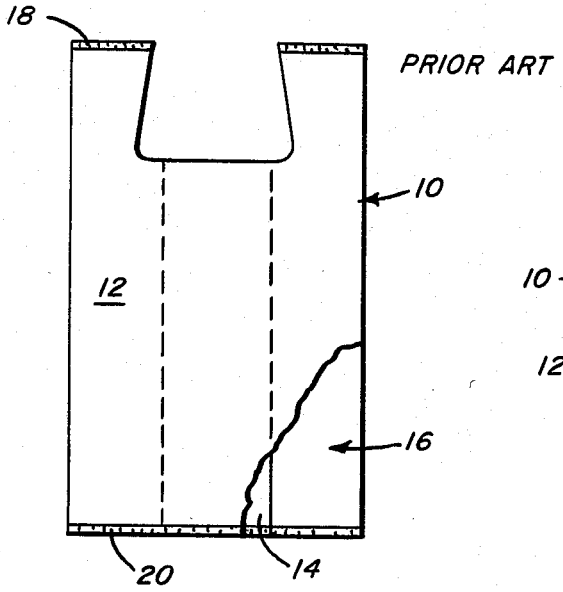
FIG. 1 is a front elevational view of a conventional gusseted thermoplastic bag, with a portion thereof broken away to more particularly illustrate an inwardly folded side gusset.
Figure 2:
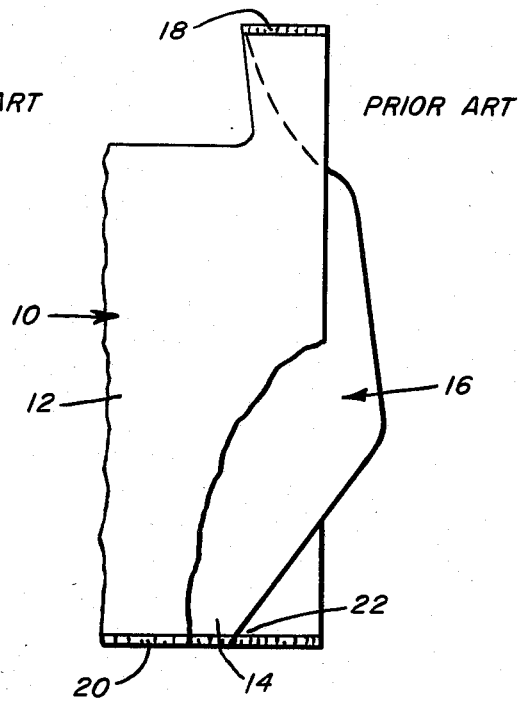
FIG. 2 is a partial elevational view of the prior art bag of FIG. 1 with one of the gussets thereof expanded outward under a normal loading condition.
Figure 3:
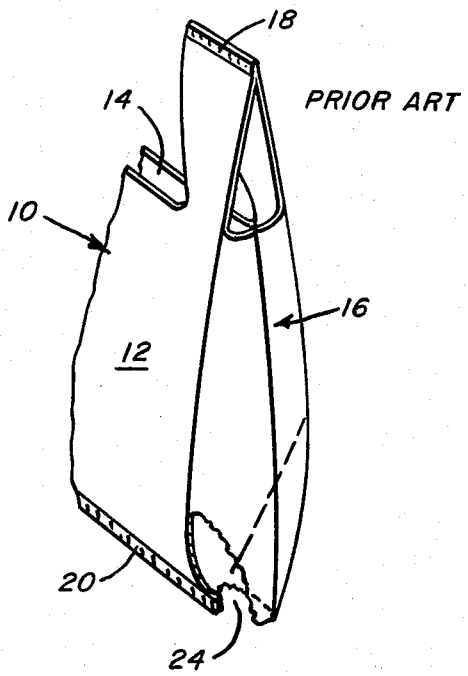
FIG. 3 is a partial perspective view illustrating full "blow out" of a prior art gusseted bag, with the lower end of the gusset torn open.
Figure 4:
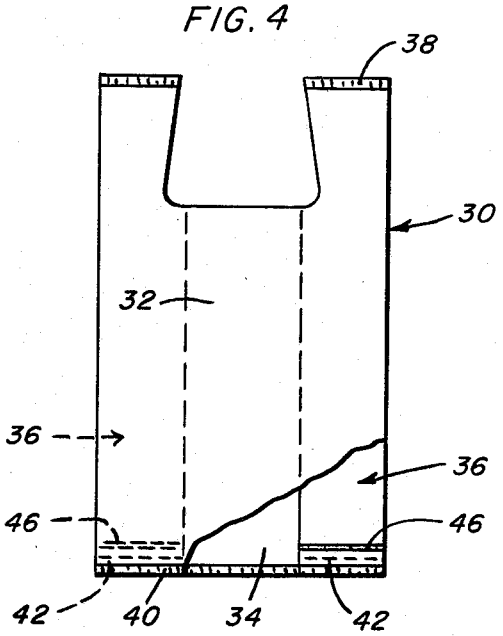
FIG. 4 is a front elevational view of a bag incorporating the features of the present invention, a portion of the bag being broken away for purposes of illustration.
Figure 5:
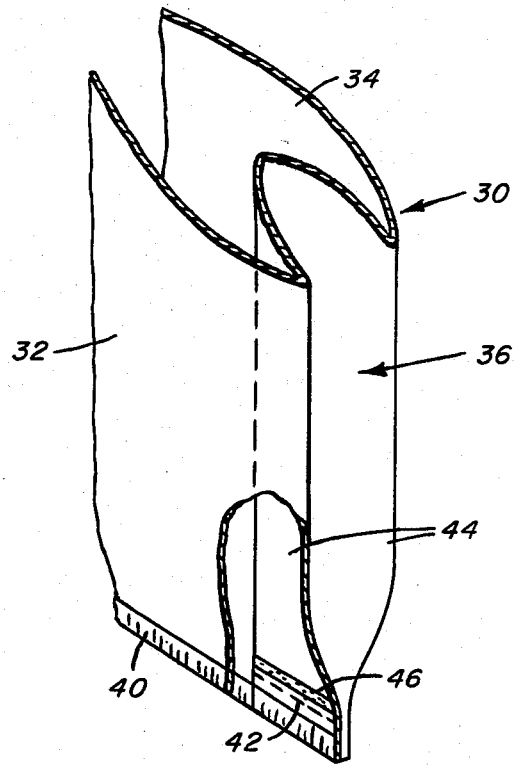
FIG. 5 is a partial perspective view of a side gusseted bag with the features of the invention incorporated therein.

Referring now more specifically to the drawings, FIGS. 1, 2 and 3 illustrate conventional side gusseted thermoplastic bags 10. Such bags include front and rear panels 12 and 14 with expandable side walls or gussets 16. Both the upper and lower peripheral edges of the front and rear panels 12 and 14 are heat sealed throughout the length thereof as at 18 and 20 with the corresponding upper and lower end of the side gussets 16 sealed therebetween.

Noting FIG. 2, as the bag 10 is opened and goods introduced therein, the gussets 16 tend to expand outward. This outward expansion is limited by the heat seamed lower ends thereof as will be noted at 22. Under normal loading conditions, this will be of little consequence and will not affect the integrity of the bag. However, under greater than normal loading, or rough handling of a loaded bag, the sealed lower ends of the gussets 16 tend to tear loose at the lower seam 20, thus resulting in a full outward expansion of the unsecured lower ends of the gussets 16 which in turn form enlarged openings 24 through the bottom of the bag to each side thereof and in alignment with the fully outwardly expanded gussets 16. As will be appreciated, such a situation is obviously not desirable both because of the substantial possibility of loss of goods through the bottom of the bag, and because of the weakening of the structural integrity of the bag.

The present invention is particularly intended to accommodate and provide for a full outward extension of bag gussets, including the end portions toward the bottom of a bag, as will inherently occur upon the introduction of a sufficiently large load. In conjunction therewith, provision is made for retaining the involved end portion or portions of the gusset completely sealed. This in turn retains the integrity of the bag.

Turning now to the specifics of the invention, attention is directed to FIGS. 4–7. The bag 30 illustrated therein is generally similar to the conventional bag of FIGS. 1–3 in that the bag 30 includes front and rear panels 32 and 34 and side gussets 36 with the upper and lower ends thereof heat sealed to define upper and lower seams 38 and 40. The bag 30 differs from the conventional gusseted bag 10 in that each gusset 36, immediately above the heat seamed lower end thereof, includes a full width transverse tear line or line of perforations 42 which extends through both of the panels 44 which comprise the gusset. In addition, immediately above the tear line 42, is a full width transverse glue or bond line 46 provided between the gusset panels or sections 44 and effectively sealing the lower portion of the gusset above the tear line 42 independent of the heat seam 40. This construction will be best appreciated from FIGS. 4 and 5 wherein it will be noted that tear line 42 and glue line 46 generally parallel the bottom seam 40. Both gussets 36 associated with a single bag will incorporate this construction.

Figure 6:
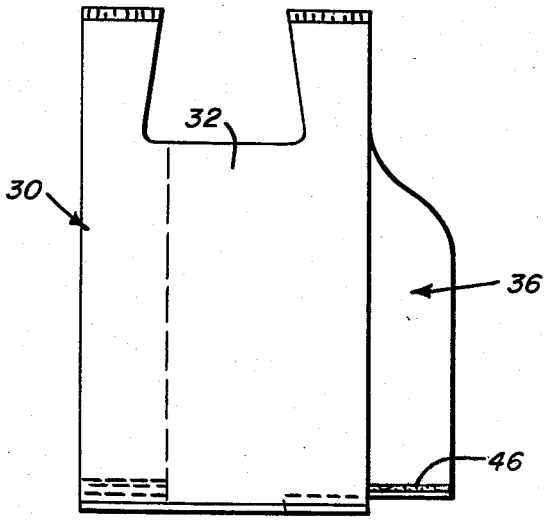
FIG. 6 is a front elevational view of the bag of FIG. 4 with one gusset outwardly expanded to the full width thereof and with the sealed integrity of the lower end of the gusset maintained.
Figure 7:
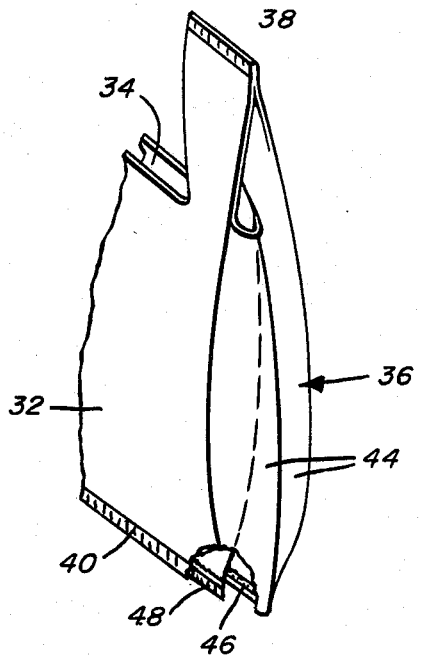
FIG. 7 is a partial perspective view of the construction of FIG. 6.

In using a bag 30 incorporating the features of the invention, the introduction of a load therein, which could effect a complete outward unfolding and tearing of the gusset in a conventional bag as in FIG. 3, will similarly cause an outward unfolding of one or more of the gussets 36. However, rather than this outward unfolding or ballooning tearing the lower end of the gusset 36 open, the tear line or line of perforations 42 will provide for a controlled severing or freeing of the lower end of the gusset 36 below the glue line 46 and above the heat sealed lower seam 40. In this manner, the integrity of the lower end of the gusset 36, even when fully extended to the side of the main body of the bag 30, will be maintained. FIGS. 6 and 7 are of interest in illustrating the outwardly inverted lower portion of an expanded gusset 36 and the adjacent main body of the bag 30. Depending upon the specific positional relationship between the tear line 42, glue line 46, and seam 40, in the expanded gusset bag, there may be a tiny aperture 48 at the inner ends of the gusset panels 44, this is in a reduced stress area of the bag and will have no affect on the structural integrity thereof.

In summary, the bag of FIGS. 4–7 is particularly concerned with the controlled expansion of the side gussets, upon the introduction of heavy and/or large loads, in a manner whereby the bottom portion of the gusset or gussets will part along a predetermined tear line before the integrity of the bottom seam is affected. In connection therewith, it will be appreciated that the tear line or line of perforations 42 weakens the transverse zone on the gusset panels to provide for a severing therealong prior to the point at which the gusset or bag will tear as occurs in the prior art, again noting FIGS. 2 and 3. Similarly, the bond or glue line 46 is to incorporate a strength approximating that of the lower seam 40. While this line 46 has been referred to as a glue line, the sealed lower portions of the gusset side panels 44 can, depending on manufacturing techniques, be provided by other means, such as heat seaming as suggested for the main bag seams.

Inasmuch as the present invention provides for a full outward expansion of the side gussets, the bag will normally assume a generally cylindrical configuration which can accommodate both larger and heavier loads, and which in fact may allow for the use of thinner, and hence less expensive, bag material.

Figure 8:
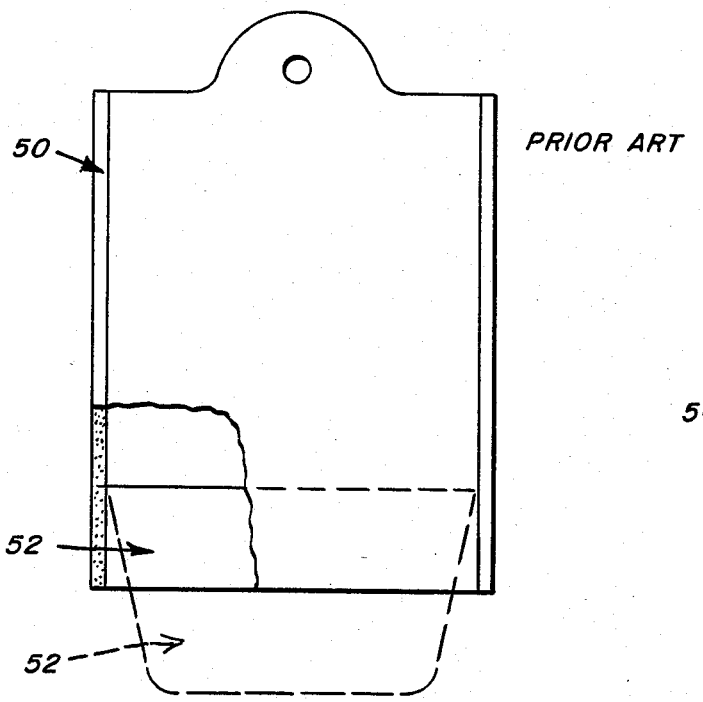
FIG. 8 illustrates a conventional bottom gusset bag with the expanded gusset shown in phantom lines, a portion of the bag being broken away for purposes of illustration.
Figure 9:
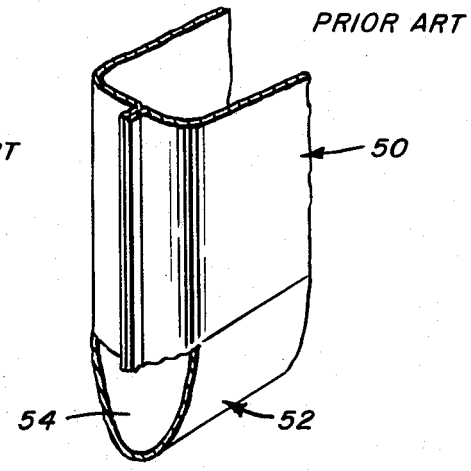
FIG. 9 is a partial perspective view of the bag of FIG. 8 with a "blow-out" at one gusset end.
Figure 10:
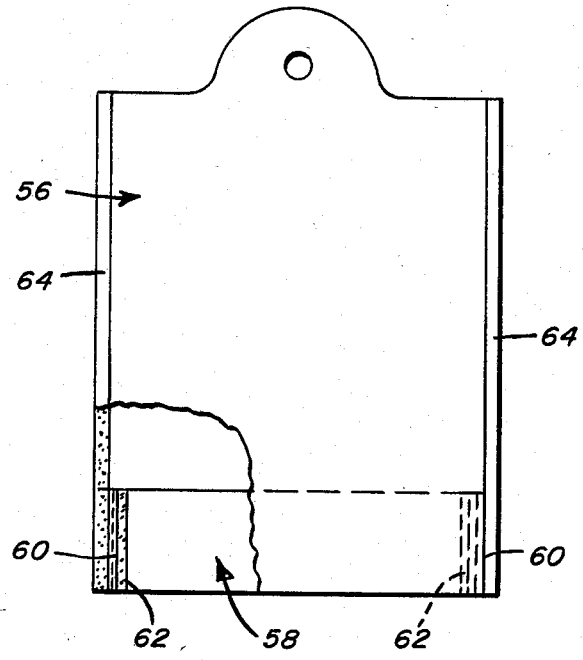
FIG. 10 is a front elevational view of a bottom gusset bag incorporating the features of the invention, a portion of the bag being broken away for purposes of illustration.

Turning now to the invention as incorporated into a bag with a bottom gusset, attention is first directed to FIG. 8 wherein a conventional bag 50 is illustrated with the bottom gusset folded therein between the front and rear bag walls. FIG. 8 also illustrates, in phantom lines, the bottom gusset 52 in its normal outwardly extended position which it assumes upon introduction of a load into the bag 50. As will be appreciated, in the extended position of the gusset 52, the lateral opposed ends thereof, conventionally heat sealed between the heat seamed side edges of the front and rear panels, are subjected to a force tending to tear the gusset ends away from the corresponding seam. This situation is similar to that previously described with regard to a conventional side gusset bag. Upon the introduction of an excess load, heavier and/or larger than a conventional load, the opposed ends of the bottom gusset will tear or "blow out" as suggested in FIG. 9. This in turn will present at least one, and normally two opposed enlarged openings 54 which will, in an obvious manner, destroy the integrity of the bag both with regard to its carrying capacity and its structural strength.

To avoid the problems noted above, and accommodate the tendency for the bottom gusset to outwardly unfold, the present invention proposes, in a bottom gusseted bag 56, that the opposed ends of the bottom gusset 58 be, similar to the bag 30, provided with both transverse tear lines 60 on the overlying gusset panels and a transverse glue or bond line 62 between the gusset panels. As is conventional, the extreme ends of the horizontal upwardly folded bottom gusset 58 are heat sealed between the heat seamed side edges 64 which conventionally secure the side edges of the front and rear bag panels.

The tear lines 60, associated with each of the opposed end portions of the gusset 58, generally parallel the side seam 64 immediately inward thereof. Each tear line, as desired, may be defined by a line of perforations causing a zone of weakness which will part prior to an actual tearing of the bag material.

The glue or bond line 62, at each of the opposed end portions of the bottom gusset 58, is provided generally parallel to the corresponding tear line 60 and side seam 64, and is adjacent and immediately inward of the corresponding tear line 60.

Figure 11:
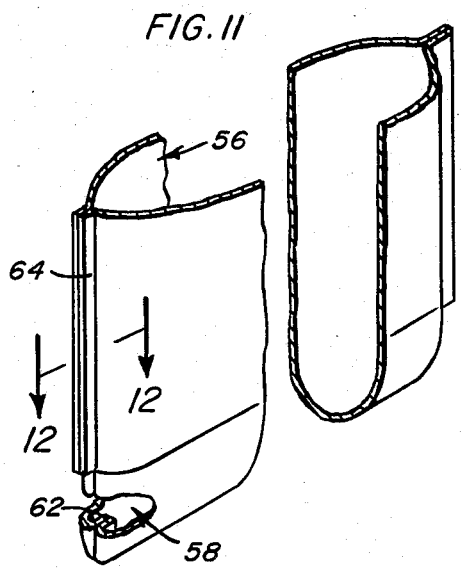
FIG. 11 is a partial perspective view, with portions broken away, of the bag of FIG. 10 with the ends of the bottom gusset outwardly expanded to the full width thereof and with the sealed integrity of the ends of the gusset maintained.
Figure 12:
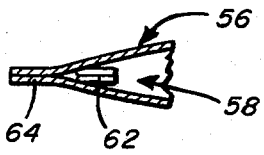
FIG. 12 is a cross-sectional detail taken substantially on a plane passing along line 12—12 in FIG. 11.

With the above described arrangement of tear lines and glue lines, it will be readily appreciated that the introduction of an excess load within the bag 56 will produce a tearing of the gusset 58, normally at both ends thereof, along the tear lines 60. This in turn will result in a downward unfolding of the gusset 58 with the sealed integrity of the gusset and bag being retained by the bond lines 62. Noting FIG. 11, the gusset actually outwardly inverts and in effect provides a bottom continuous with the inner and outer walls of the bag 56. As will be appreciated, the glue or bond lines 62 secure the corresponding ends of the two panels which comprise the gusset 58 together with a strength at least equal to that of the side seams 64, as well as the strength of the material of the bag itself. Depending upon the specific positional relationship between each tear line 60, the corresponding glue line 62 and side seam 64, there may be a tiny aperture, in the expanded gusset bag, between each glue line or seam 62 and the corresponding side seam 64. However, this will in no way affect the structural integrity of the bag. Further, while the lines 62 have been referred to as glue lines, depending on manufacturing techniques, other means to achieve a desired seal or seaming can be used.

The tear away bag gusset of the invention actually utilizes what has been a bothersome defect in the design of bags of the type involved herein, that is the tendency for the gusset to "blow out". By providing a specific preformed line or lines of severance for the gusset, along with means for maintaining the integrity of the gusset immediately inward of the line or lines of severance, applicant has provided for and accommodates the inherent tendency of the end portions of gussets to expand outward, and avoids the problem of the gussets tearing open.

The foregoing is considered illustrative of the principles of the invention. The particular nature of the tear lines 42 and 60 and glue lines or seals 46 and 62 inward thereof can vary within the scope of the invention. The particular significance of these features is the ability of the tear lines to sever before the structural integrity of the lower portion of the bag is effected. The glue line, in turn, provides for a structural integrity sufficient to maintain a load generally corresponding to that accommodated by the remainder of the bag, including the seams thereof.

I claim:

1. A bag construction comprising overlying front and rear bag walls with overlying peripheral edges, at least one gusset extending between said front and rear bag walls and along a length of said overlying peripheral edges, said gusset including a pair of integrally joined panels having opposed ends and end portions immediately adjacent said ends, said panels being inwardly folded into overlying relation to each other between said front and rear bag walls along said length of overlying peripheral edges for a selective outward unfolding, relative to said length, in conjunction with the introduction of goods into the bag, said gusset including opposed ends, each defined by an overlying pair of the panel ends, means bonding selected portions of the overlying edges of the front and rear bag walls, at said panel ends, to each other with an overlying pair of said panel ends received and bonded therebetween to define a sealed bag gusset between the front and rear bag walls, means for weakening the end portions of the panels of the gusset transversely thereacross in closely space relation inward of the ends of the gusset panels bonded between the front and rear bag walls to provide for a selective and controlled severing of the gusset inward of the bonded ends of the gusset panels, and means for sealing the panels of the gusset to each other in closely spaced relation inward of the means for weakening the end portions of the panels to retain a sealing of the end portions of the gusset panels to each other subsequent to a severing of the gusset at and along the means for weakening.

2. The bag construction of claim 1 wherein said means for weakening the end portions is defined by a line of perforations through each gusset panel.

3. The bag construction of claim 1 wherein said gusset defines a side wall of the bag, one of said gusset ends comprising a bottom end, said selected portions of the overlying peripheral edges of the front and rear bag walls comprising bottom edges bonded to each other with the bottom end of the gusset received and bonded therebetween to define a sealed bag bottom, said means for weakening the end portions of the panels being defined in closely spaced relation above the sealed bag bottom, and said means for sealing the panels of the gusset to each other being in closely spaced relation above the means for weakening.

4. The bag construction of claim 3 including a second gusset defining a second side wall of the bag laterally opposed to the first side wall and similarly including a bottom end bonded between the bottom edges of the front and rear bag walls.

5. The bag construction of claim 1 wherein said gusset defines a bottom of the bag, said selected portions of the overlying peripheral edges of said front and rear bag walls comprising opposed pairs of overlying side edges bonded to each other, said opposed gusset ends being at said opposed pairs of side edges, and being received and bonded therebetween.

6. The bag construction of claim 5 wherein each gusset end portion includes the means for weakening defined transversely thereacross, and, in closely spaced inward relation thereto, the means for sealing the gusset panels together transversely thereacross.

7. A bag construction comprising front and rear bag walls, opposed side gussets extending between said bag walls to the opposed sides thereof, each gusset including a pair of integrally joined panels inwardly folded into overlying relation to each other between said bag walls for a selective outward unfolding in conjunction with the introduction of goods into the bag, said bag walls including bottom edges, each of said gussets including a bottom end on each of the panels thereof, means bonding the bottom edges of the bag walls to each other with the bottom ends of each pair of gusset panels received and bonded therebetween to define a sealed bag bottoms, each gusset, inward of the bonded lower panel ends, having the overlying panels thereof bonded to each other along a bond line transversely across the gusset, each said gusset, including the two panels thereof between the sealed bottom and the bond line, having a transverse portion readily severable relative to the remainder of the gusset, to enable, under a bag received load, a severance of said gusset along said transverse portion and an outward unfolding thereof independently of the sealed bag bottom with the bond line retained between the panels of the gusset and defining a sealed bottom for said gusset independent of the sealed bottom of the bag.

8. A bag construction comprising front and rear bag walls, a bottom wall extending between said front and rear bag walls, said bottom wall comprising a gusset, said gusset including a pair of integrally joined panels inwardly folded into overlying relation to each other between said front and rear bag walls for a selective outward unfolding in conjunction with the introduction of goods into the bag, said front and rear bag walls including opposed side edges, said gusset including opposed ends on each of the panels thereof, means bonding the side edges of the front and rear bag walls to each other with the opposed ends of the gusset panels received and bonded therebetween to define sealed bag sides, means for weakening portions of the panels of the gusset transversely thereacross in closely spaced relation inward of each sealed bag side to provide for a selective and controlled severing of the gusset inward of the sealed bag sides, and means for sealing the panels of the gusset to each other in closely spaced relation inward of the means for weakening the portions of the panels to retain a sealing of the end portions of the gusset panels to each other subsequent to a severing of the gusset at the sealed bag sides.

9. In a bag comprising front and rear bag walls having overlying peripheral edges with a gusset between coextensive lengths of said overlying edges, said gusset being defined by overlying panels and having opposed ends, said panels being bonded together between overlying sections of said peripheral edges transversely across said panels at one of said gusset ends; the improvement comprising means bonding said panels together in inwardly spaced relation to the said one gusset end, and means between said one gusset end and said bonding means defining a tear area transversely across said gusset and the panels thereof.

* * * * *